US005251259A

United States Patent [19]

Mosley

[11] Patent Number: 5,251,259

[45] Date of Patent: Oct. 5, 1993

[54] PERSONAL IDENTIFICATION SYSTEM

[76] Inventor: Ernest D. Mosley, 572 Dunleith, Greenville, Miss. 38701

[21] Appl. No.: 932,689

[22] Filed: Aug. 20, 1992

[51] Int. Cl.[5] ..... H04K 1/00

[52] U.S. Cl. ..... 380/23; 380/24; 380/52; 235/380; 235/382.5

[58] Field of Search ..... 380/23, 24, 25, 49, 380/50, 52; 235/379, 380, 382.5

[56] References Cited

U.S. PATENT DOCUMENTS

| | | | |
|---|---|---|---|
| 4,449,040 | 5/1984 | Matsuoka et al. | 235/380 |
| 4,510,382 | 4/1985 | Walter . | |
| 4,528,442 | 7/1985 | Endo . | |
| 4,727,975 | 3/1988 | Eisermann . | |
| 4,766,294 | 8/1988 | Nara et al. | 235/380 |
| 4,800,590 | 1/1989 | Vaughan . | |
| 4,962,530 | 10/1990 | Cairns | 380/23 |
| 5,034,597 | 7/1991 | Atsumi et al. | 235/380 |
| 5,177,789 | 1/1993 | Covert | 380/23 |

*Primary Examiner*—Tod R. Swann

*Attorney, Agent, or Firm*—Jacobson, Price, Holman & Stern

[57] ABSTRACT

A group of seven (7) PINs are assigned to each card holder. The group of PINs are to be used in a specific sequence changing each calendar day. If a PIN is used out of sequence, then access to the charge or credit card is denied by the card company. A grid of numbers and letters are used to vary the PIN each day. The grid includes seven (7) rows and seven (7) columns with the numbers 1 through 7 randomly selected and placed in the seven (7) rows and columns. The rows and columns, when utilized correctly, allow the card holder to access seven three-digit codes. The codes or personal identification numbers must be used in the correct sequence which is determined by the number of uses per calendar day.

7 Claims, 3 Drawing Sheets

PERSONAL IDENTIFICATION SYSTEM

FIELD OF THE INVENTION

The present invention is designed to prevent charge and credit card fraud.

BACKGROUND OF THE INVENTION

At present, if an unfriendly user has access to a charge or credit card account number, the name of the card holder and the expiration date, then the unfriendly user can utilize the charge or credit card by telephone order, mail order or otherwise until the authorized use is reported by the card holder. Such unauthorized use of charge or credit cards has increased dramatically in recent years and has cost the industry more than a billion dollars.

Current practice of local telephone companies, long distance services and financial institutions is to utilize account numbers and personal identification numbers (PINs) which customers utilize to access their accounts. Some examples of such use and other anti-theft practices are described in U.S. Pat. No. 4,528,442 to Endo, U.S. Pat. No. 4,727,975 to Eisermann, U.S. Pat. No. 4,510,382 to Walter and U.S. Pat. No. 4,800,590 to Vaughan.

The Endo patent, U.S. Pat. No. 4,528,422, discloses a personal identification method where the user of a card is asked a predetermined set of questions which must be answered correctly in order to be granted access to the system. Each of the answers is initially provided by the authorized card user during a registration process. In one embodiment, the patent describes varying the order that the questions are asked, and varying which questions get asked each time a user tries to access the system.

Eisermann, U.S. Pat. No. 4,727,975, discloses a combination lock system where the combination is changed automatically each time the lock is used.

The Walter patent, U.S. Pat. No. 4,510,382, discloses a method for preventing use of unauthorized copies of magnetic cards. The method includes a step during which the serial number and the number of times the card has been used are read from the magnetic card by a presently used automatic service machine. Also read from each card, are the serial number of another card and the number of times the other card has been used, this latter information having been previously recorded onto the presently used magnetic card by the most recently used automatic service machine. The "other" card is preferably the card which happened to be used in the most recently used automatic service machine, just before the present card was used therein. The number of uses of the present card is then incremented and compared to a previous number of uses stored in the automatic service machine. If the number of uses is not greater for the present card, then a false card is detected.

The Vaughan patent, U.S. Pat. No. 4,800,590, discloses a computer access system for selectively granting access to a host computer. Passwords generated from PIN numbers are varied as a function of time and a pseudo-random number. The access system disclosed comprises a password generator and a lock computer responsive to passwords generated by the generator. If a password generated by the password generator matches a password separately generated by the lock computer, access to the host computer is granted. The password generator and the lock computer have corresponding pseudo-random number sequences stored in their respective memories. The password generator and the lock computer have synchronized clocks, which define time intervals. During any given time interval, entry of a PIN into the password generator will cause the password generator to generate a unique password from the random number sequence in memory and from time interval information provided by its clock. The user, by entering his/her PIN number, causes the so-generated password to be transmitted to the lock computer which independently generates a comparison password from the corresponding pseudo-random number sequence stored in its respective memory and from the time interval defined by its clock. If the two passwords match, access to the host computer is granted by the lock computer. Since the valid passwords change with each time interval, subsequent use of an intercepted password will not grant access to the computer.

SUMMARY OF THE INVENTION

The present invention utilizes a group of seven (7) or more (up to ten (10)) PINs assigned to each card holder. The group of PINs are to be used in a specific sequence changing each calendar day. If a PIN is used out of sequence, then access to the charge or credit card is denied by the card company.

A grid of numbers and letters are used to vary the PIN each day. The grid includes seven (7) rows and seven (7) columns with the numbers 1 through 7 randomly selected and placed in the seven (7) rows and columns. The rows and columns, when utilized correctly, allow the card holder to access seven three- or four-digit codes. The codes or personal identification numbers must be used in the correct sequence which is determined by the number of uses per calendar day. The grid also includes a row of letters at the top of the columns. The letters are SMTWTFS representing the calendar days of the week, Sunday, Monday, Tuesday, Wednesday, Thursday, Friday and Saturday. The column directly below each letter consists of the number 1 through 7 in randomly selected order. The numbers represent the number of times of use of the card on that calendar day—1 for the first use of the day, 2 for the second use of the day, 3 for the third use of the day, etc. If the card is used more than seven times in one calendar day, then the sequence is repeated substituting eight for one, nine for two, ten for three, etc.

The grid further includes a row of letters at the bottom of the grid. The letters are a combination of any seven (7) of the 26 letters of the alphabet in randomly selected order. Three (3) of the seven (7) letters are selected in successive or random order and assigned to the card holder to be memorized. The three (3) columns of numbers directly above the assigned three letter sequence are the seven three-digit codes or P.I.N.s. To determine the correct PIN, the card holder determines whether the use is the first—1, second—2, third—3, etc. of that calendar day, locates the corresponding number in that column and then locates the three number PIN on that row. Therefore, if a card holder knows what day it is, how many times he or she has used the card on that day and his or her three letter code, then the card holder can use the invention.

If the use of the card is by telephone, then the card holder would provide the vendor with the account number, his or her name, the expiration date and the correct PIN and the vendor would transmit the information by electronic means to the card company which would approve or reject the request dependent upon the information provided. If the use of the card is at a traditional retail or food establishment with a scanner, then the card holder would provide the vendor with his or her card, the vendor would scan the card's magnetic strip, the card holder would verbally provide the vendor with the correct PIN and the vendor would input the PIN into the scanner by typing the appropriate number keys. The information would be transmitted by electronic means to the card company and the card company would approve or reject the request dependent upon the information provided.

The card company would maintain a record of the PINs, three letter codes and sequence of usage by electronic means and be used by the card companies as another record of information necessary to approve or reject charge or credit card requests.

This inventive use of a group of sequenced PINs would be effective in preventing credit card fraud by telephone order, by mail order or at traditional retail and food establishments with or without scanners but in it preferred embodiment, is designed to prevent credit card fraud in telephone order uses.

It is an object of the invention to control credit card fraud by the use of a changeable personal identification number (PIN).

It is yet another object of the invention to control credit card fraud by the use of a changeable personal identification number (PIN) with the PIN changing according to the day of the week and the number of uses each day of the credit card.

It is another object of the invention to control credit card fraud by the use of a changeable personal identification number (PIN) with the PIN changing according to the day of the week and the number of uses each day of the credit card with the particular PIN for a particular transaction being transmitted to a credit card company for comparison and determination if the correct PIN is being used.

It is still yet another object of the invention to control credit card fraud by the use of a changeable personal identification number (PIN) with the PIN changing according to the day of the week and the number of uses each day of the credit card with the particular PIN for a particular transaction being transmitted to a credit card company for comparison and determination if the correct PIN is being used with the credit card company authorizing use when the correct PIN number is transmitted and requesting a different PIN when an incorrect PIN number is transmitted.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
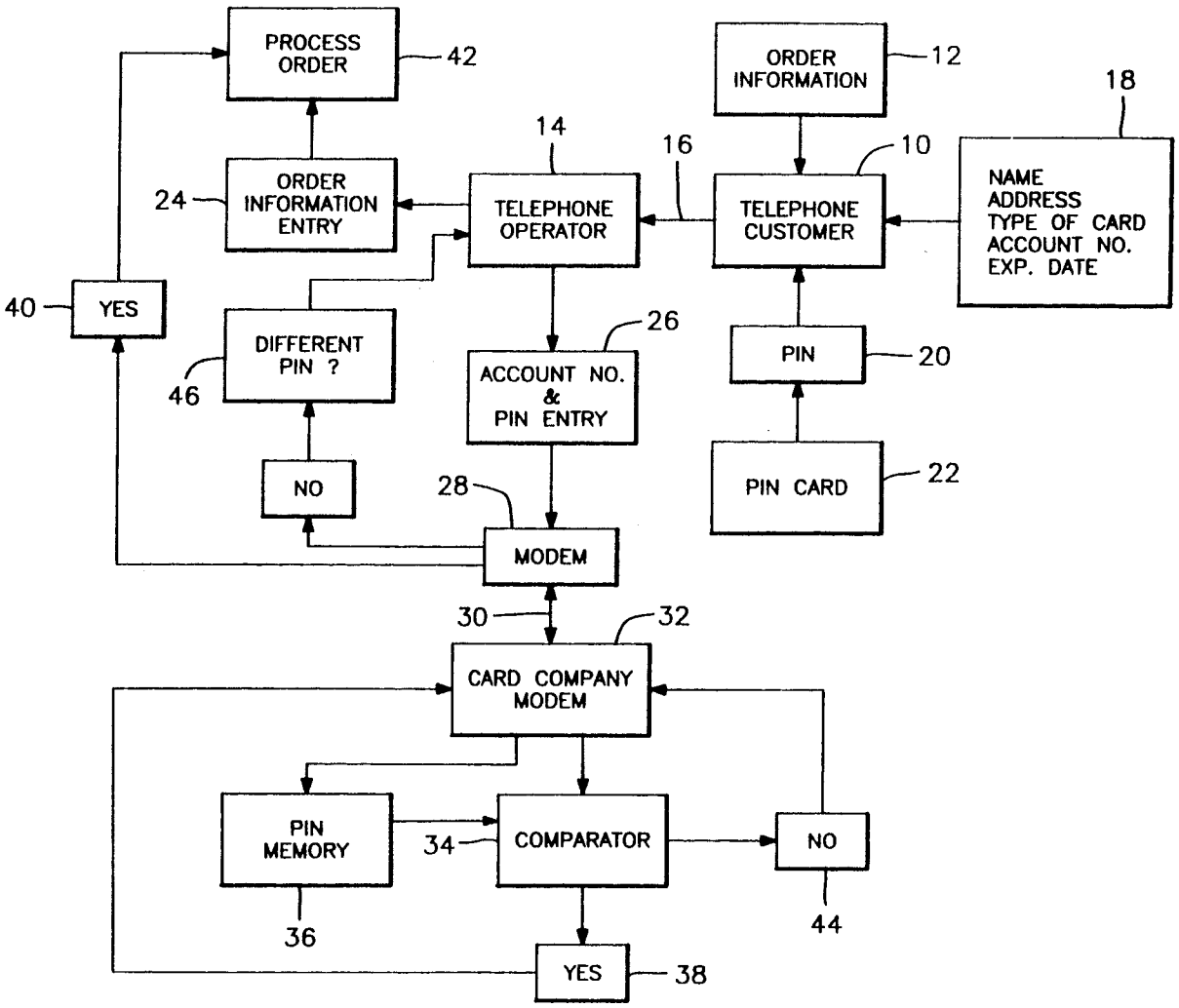
FIG. 1 is a flowchart of the use of the invention during telephone sales.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
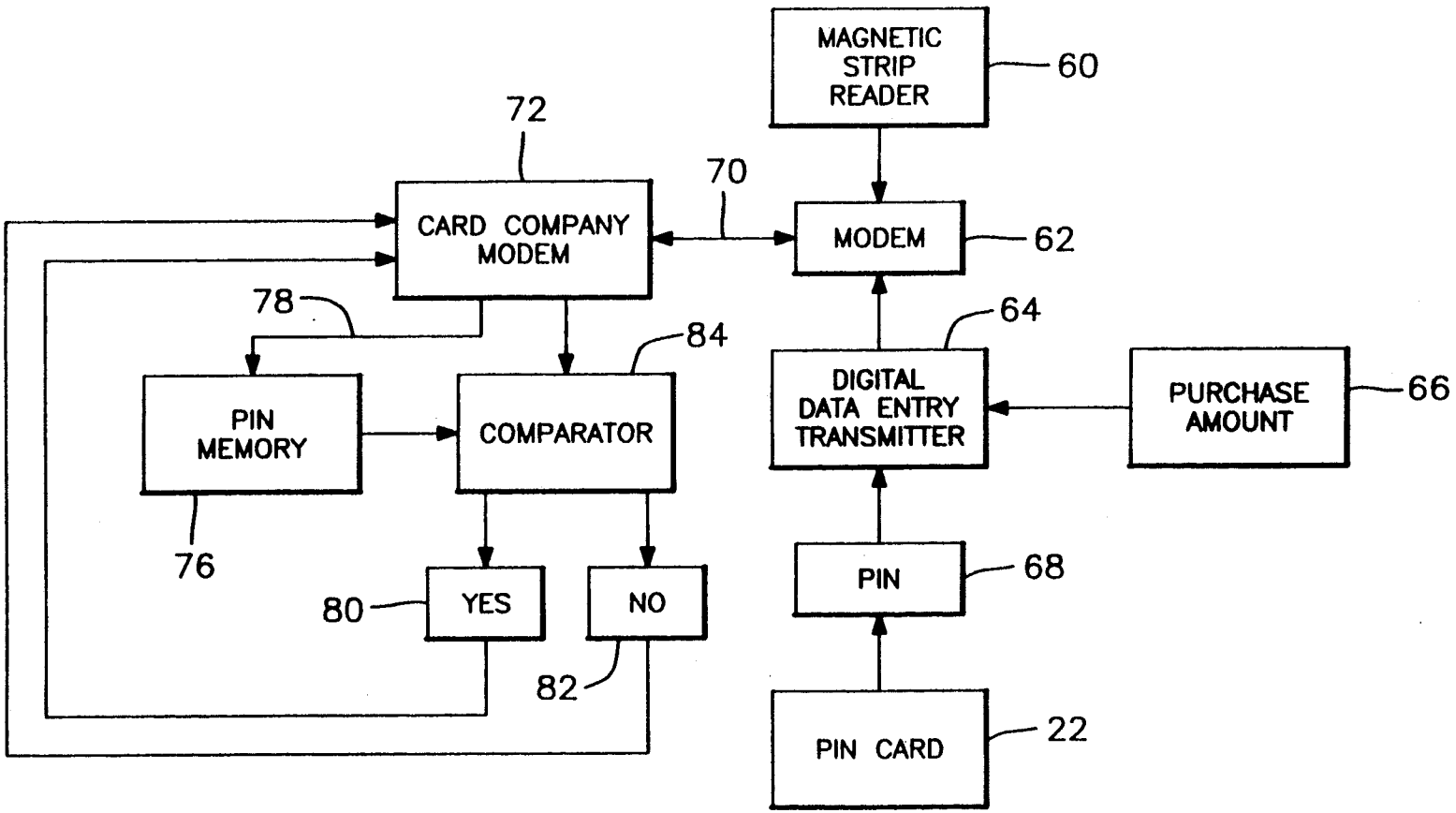
FIG. 2 is a flowchart of the use of the invention for retail sales.

With reference to the drawings, in general, and to FIGS. 1 and 2, in particular, a system embodying the teachings of the subject invention is shown.

With reference to FIG. 1, the system is schematically shown for use in ordering of goods by telephone. A telephone customer 10 will convey order information 12 to obtain the desired product or accomplish a specific task, such as payment of a bill, to a telephone operator 14 by a bi-directional telephone link 16. The telephone operator 14, in addition to soliciting of the order information 12, will require additional information 18, such as the customer's name, address, type of credit to be used, the account number of the credit card and its expiration date. Other information may also be solicited as needed.

Figure 3:
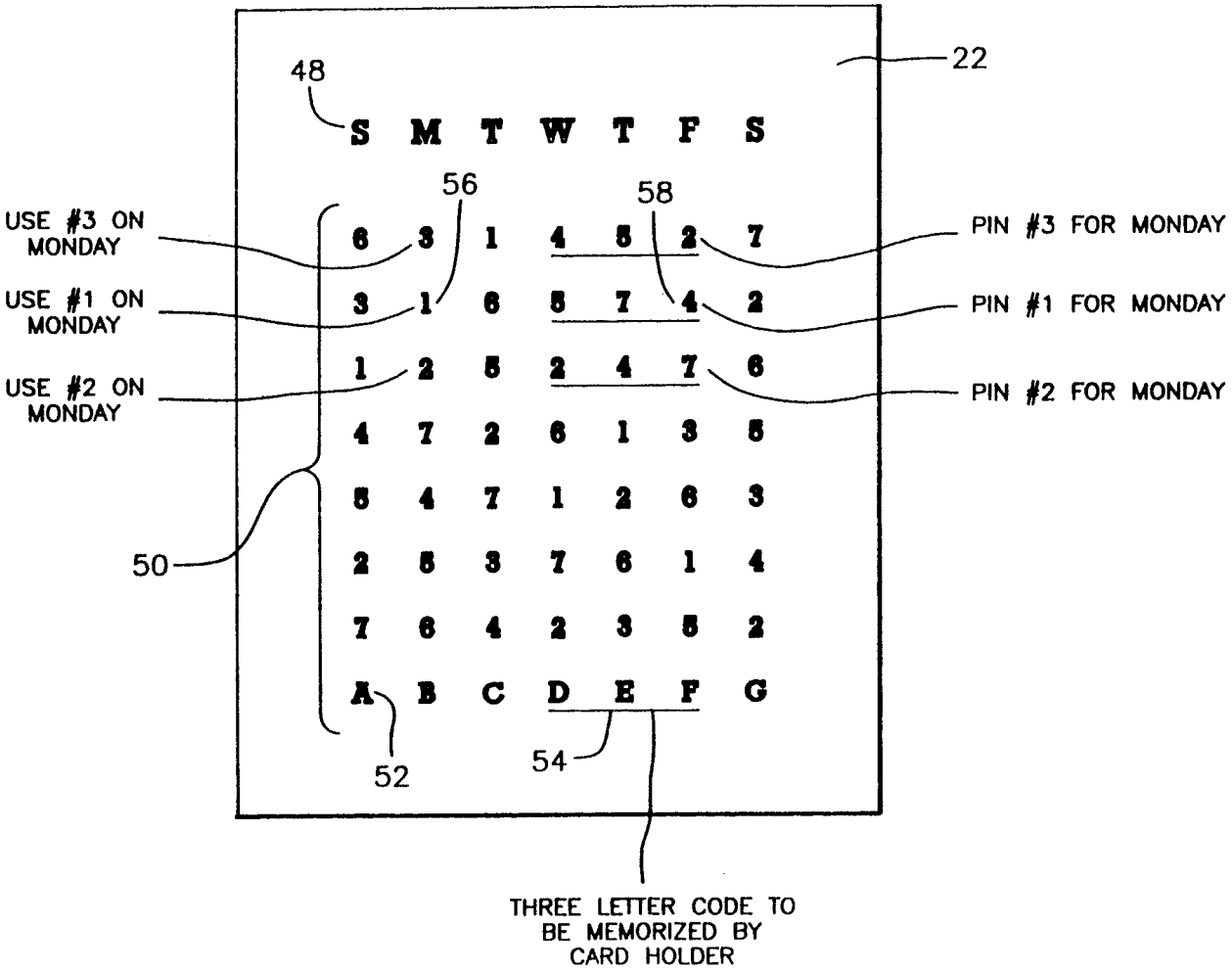
FIG. 3 illustrates a PIN card.

Finally, the telephone operator 14 will request from the telephone customer 10 a personal identification number 20 which is to be used for this particular transaction to verify that telephone customer 10 is authorized to use the credit card. The telephone customer 10 obtains the PIN number 20 for a particular transaction from PIN card 22. The specific PIN number to be used in a particular transaction as obtained from PIN card 22 will be explained in greater detail with respect to FIG. 3 which illustrates a PIN card 14.

The telephone operator 14 makes an order information entry 24 for processing of an order. The PIN number 20 and card account number communicated to the telephone operator is entered by the telephone operator at account number and PIN entry 26 which is connected to a modem 28 for establishing a bi-directional link 30 with a modem connection 32 of the credit card company. The account number and PIN entry 26 communicated to the credit card company is sent to a comparator 34 which compares a predetermined PIN number entered from PIN memory 36 for comparison with the PIN number provided by the customer 10 for a particular transaction.

If the PIN number from PIN memory 36 matches with the PIN number 20 provided by the customer 10, a positive confirmation 38 is communicated to the telephone operator by modem connection 32 so that the positive confirmation 40 initiates a process order signal 42 to accept the order information entry 24 and allow the purchase of the order by the customer.

If the comparator 34 indicates that a match has not been obtained by signal 44, a message is sent through modem connection 30 to advise the operator 14 to obtain a different PIN, as indicated at 46. Depending upon the policy of the company from which a product is being ordered or being paid for, the operator may request a different PIN number or terminate the entry of the order information 24.

To determine the correct PIN number to use for a particular transaction, the customer makes use of PIN card 22 which has been given to the customer during the original issuance of a credit card. Information provided on the PIN card 22 is stored in the PIN memory 36 of the credit card company for a particular credit card account number. Each credit card account number is issued a different PIN card 22. The grid can also be attached to the customer's credit card.

On the PIN card 22 are a series of seven columns with the first row 48 including the first letter of the days of the week. The next seven rows 50 include a random sequence of numbers 1 through 7. The number of rows 50 and columns 56 can be increased or decreased depending upon the amount of activity expected for a particular credit card account number.

The last row 52 includes the letters A through G in proper sequence. Of the letters in row 52, the customer or the credit card company assigns three of the letters, in sequence or in random sequence, which for illustrative purposes in the example, are the letters D, E and F, which are underlined by line 54. Normally, these three letters would not be underlined in case the PIN card were lost with the credit card and thereby providing someone who finds the credit card and the PIN card access to the use of the credit card. Therefore, the three designated letters from row 52 are normally memorized by the card holder.

Depending upon the day of the week in which the credit card is to be used, the customer would look down the appropriate column in the columns labeled by the first letter of the day of the week. For illustrative purposes, it is assumed that a customer is completing a transaction on Monday and according to the occurrences of use, the first use on Monday would cause the customer to find the number 1 as at 56 in the column under the label "M" for Monday. The customer would then seek the columns from which letters have been chosen from row 52 and look up to the row in which the number 1 at reference numeral 56 dictates, to obtain the three-digit PIN number for the first use of the credit card on Monday. As indicated by reference 56, in this example, the PIN number is 574.

Similarly, for each use of the credit card on a particular day, the usage number would be located and the PIN number determined for that use for a particular day. If, in the example shown, more than seven uses are performed in one day, the eighth use would simply use the same number as for the first use, since there are only seven numbers in each column in the example shown.

The customer would thereby obtain a PIN number for a particular transaction on a particular day and communicate that PIN number to a requestor to be communicated to the credit card company. The credit card company would similarly be tracking usage of a credit card account number on a particular day and its number of occurrences of use so as to provide the correct PIN number from memory 36 to a comparator 34 for authorization of the use of a credit card. The PIN card 22 could be maintained by the customer with or separate from the credit card since, in the preferred embodiment, there are no underlinings of the three letter code from row 52 which would enable anyone to use the credit card and obtain the correct PIN number.

Similarly, in retail sales, as schematically shown in FIG. 2, the retailer, whether it be a store or a restaurant, will use a magnetic strip reader 60 for obtaining certain information about a credit card by passing its magnetic strip on the rear of the card through the magnetic strip reader. This information is sent to a modem 62 located at the place of business. A digital data entry transmitter 64 is also connected to the modem 62 for entering information such as a purchase amount 66. In addition, a PIN number 68 is obtained from the customer's PIN card 22 for a particular transaction. The PIN number 68 is entered into the data entry transmitter and sent by modem 62 over a bi-directional communication link 70 to the credit card company modem 72. The modem 72 transmits the PIN number 68 to a comparator 74 which is connected to a PIN number memory 76. The account number from the modem 72 as transmitted by line 78 generates a particular PIN number from PIN number memory 76 which is sent to comparator 74 where the PIN number 68 is compared to the PIN number from PIN number memory 76.

If the comparison authenticates the PIN number 68, an authorization signal 80 is transmitted from the modem 72 to the modem 62 so that the retailer may accept the customer's credit card. If the comparison generates a no-match signal 82, the modem 72 transmits this information to the modem 62 so the retailer can decide to deny request for use of a credit card or request a new PIN number to be entered into the system again to see if a match is made.

By the present invention, an immediate determination is made of a proper use of a credit card. The continuous changing of personal identification number dependent upon day and frequency of use provides a constant check against fraudulent use of a credit card.

Having described the invention, many modifications thereto will become apparent to those skilled in the art to which it pertains without deviation from the spirit of the invention as defined by the scope of the appended claims.

I claim:

1. A credit card fraud prevention system comprising:
communication means for conveying a personal identification number and credit card information,
personal identification number card means for providing said personal identification number to be conveyed by said communication means dependent upon a day and frequency of use of said credit card, said personal identification number being varied by said personal identification number means according to a day and frequency of use of said credit card, and
comparator means for comparing said personal identification number conveyed by said communication means against a predetermined personal identification number, said predetermined personal identification number being selected dependent upon the day and frequency of use of said credit card.

2. A credit card fraud prevention system according to claim 1, wherein said comparator means includes a personal identification number memory for storing information contained in said personal identification number card means.

3. A credit card fraud prevention system according to claim 2, wherein said communication means includes a telephone.

4. A credit card fraud prevention system according to claim 3, wherein said communication includes a modem.

5. A credit card fraud prevention system according to claim 1, wherein said personal identification number card means includes randomly arranged numbers aligned in rows and columns.

6. A method of preventing credit card fraud, said method comprising:

selecting a personal identification number based upon a day of use and a frequency of use of a credit card, communicating said personal identification number and information about said credit card to a credit card company, comparing said personal identification number against a predetermined personal identification number, said predetermined personal identification number being selected dependent upon day of use and frequency of use of said credit card, and authorizing use of said credit card by said credit card company upon a match of said personal identification number and said predetermined personal identification number.

7. A method according to claim 6, wherein said personal identification number changes from use to use of said credit card.

* * * * *